US012017125B2

(12) United States Patent
Takeuchi

(10) Patent No.: US 12,017,125 B2
(45) Date of Patent: Jun. 25, 2024

(54) GOLF BAG

(71) Applicant: Sumitomo Rubber Industries, Ltd., Hyogo (JP)

(72) Inventor: Hiroyuki Takeuchi, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 123 days.

(21) Appl. No.: 17/456,656

(22) Filed: Nov. 29, 2021

(65) Prior Publication Data

US 2022/0203186 A1 Jun. 30, 2022

(30) Foreign Application Priority Data

Dec. 25, 2020 (JP) ..... 2020-217823
Dec. 25, 2020 (JP) ..... 2020-217824
Dec. 25, 2020 (JP) ..... 2020-217825

(51) Int. Cl.
*A63B 55/50* (2015.01)

(52) U.S. Cl.
CPC ..... *A63B 55/50* (2015.10)

(58) Field of Classification Search
CPC ..... A63B 55/50; A63B 55/00; A63B 2102/32; A45C 13/04; A45C 2003/007
USPC ..... 206/315.8
See application file for complete search history.

(56) References Cited

U.S. PATENT DOCUMENTS 877,353 A * 1/1908 Marker ..... A63B 55/00 206/315.8
1,197,298 A * 9/1916 McGregor ..... A63B 55/50 248/96
1,556,286 A * 10/1925 Keeler ..... A63B 55/00 206/315.8
1,902,644 A * 3/1933 Hotze ..... A63B 55/00 206/315.8
2,599,635 A * 6/1952 Hotze ..... A63B 55/00 206/315.8
4,147,271 A * 4/1979 Yamaguchi ..... B65D 1/165 220/609
4,600,100 A * 7/1986 Solheim ..... A63B 55/40 206/315.6
5,402,883 A * 4/1995 Shin ..... A63B 55/408 206/315.6

(Continued)

FOREIGN PATENT DOCUMENTS

CN 111330239 A * 6/2020
JP 2008-023242 A 2/2008
KR 20070098601 A * 10/2007

OTHER PUBLICATIONS

KR 20070098601 A: English Translation (Year: 2023).*

*Primary Examiner* — Don M Anderson
*Assistant Examiner* — Justin Caudill
(74) *Attorney, Agent, or Firm* — Studebaker & Brackett PC

(57) ABSTRACT

A golf bag 100 according to one aspect of the present disclosure includes: a tubular bag main body 10 housing a golf club 101; and a bottom part 20 attached to a lower end of the bag main body 10. The bottom part 20 includes a bottom surface portion 30 protruding so as to become large in height as the bottom surface portion 30 extends toward a middle portion 31. The bottom surface portion 30 includes one or both of a bent portion 36 and a inflection portion 34. The bent portion 36 has a bent section. The inflection portion 34 has a section that changes from a depression to a projection.

5 Claims, 4 Drawing Sheets

(56) References Cited

U.S. PATENT DOCUMENTS

| | | | | | |
|---|---|---|---|---|---|
| 5,482,160 | A * | 1/1996 | Perrin | A63B 55/40 | 135/125 |
| 5,549,263 | A * | 8/1996 | Maeng | A63B 55/57 | 206/315.7 |
| 6,062,383 | A * | 5/2000 | Han | A63B 55/57 | 206/315.3 |
| 6,299,183 | B1 * | 10/2001 | Kaneko | A63B 55/60 | 280/47.24 |
| 10,858,138 | B2 * | 12/2020 | Joshi | B65B 3/022 | |
| 2003/0111371 | A1 * | 6/2003 | Okuyama | A63B 55/00 | 206/315.3 |
| 2003/0196926 | A1 * | 10/2003 | Tobias | B65D 1/0284 | 206/509 |
| 2004/0200746 | A1 * | 10/2004 | Kang | A63B 55/00 | 206/315.3 |
| 2007/0045220 | A1 * | 3/2007 | Pedmo | B65D 1/0284 | 215/375 |
| 2007/0084821 | A1 * | 4/2007 | Bysick | B65D 1/0284 | 215/373 |
| 2007/0215500 | A1 * | 9/2007 | Jung | A63B 55/408 | 206/315.6 |
| 2009/0308835 | A1 * | 12/2009 | Boukobza | B65D 1/0284 | 215/370 |
| 2013/0087568 | A1 * | 4/2013 | Hermel | B65D 1/0284 | 220/600 |
| 2014/0202898 | A1 * | 7/2014 | Anderson | A63B 55/20 | 206/315.3 |
| 2018/0369663 | A1 * | 12/2018 | Wang | A63B 55/40 | |

* cited by examiner

GOLF BAG

CROSS-REFERENCE TO RELATED APPLICATION

This application claims priority to and the benefit of Japanese Patent Application Nos. 2020-217823, 2020-217824 and 2020-217825, filed on Dec. 25, 2020, the entire disclosures of which are incorporated herein by reference.

BACKGROUND OF THE INVENTION

1. Field of the Invention

The present disclosure relates to a golf bag.

2. Description of the Related Art

A golf bag includes a bottom part corresponding to a bottom portion. The bottom part requires certain rigidity or more. When the rigidity of the bottom part is high, deformation of the bottom part can be suppressed, and falling-down of the golf bag can be suppressed. Proposed as a method of increasing the rigidity of the bottom part is a method of forming a bottom part having a multiple structure (see Japanese Laid-Open Patent Application Publication No. 2008-23242, for example).

SUMMARY OF THE INVENTION

However, when forming the bottom part having the multiple structure, the manufacturing process is complex, and the weight increases.

The present disclosure was made under these circumstances, and an object of the present disclosure is to provide a golf bag including a bottom part which has high rigidity, is easily manufactured, and is lightweight.

A golf bag according to one aspect of the present disclosure includes: a tubular bag main body housing a golf club; and a bottom part attached to a lower end of the bag main body and including a bottom surface portion and an annular outer peripheral portion, the bottom surface portion protruding so as to become large in height as the bottom surface portion extends toward a middle portion of the bottom surface portion, the outer peripheral portion being arranged so as to surround the bottom surface portion and integrated with the bottom surface portion.

According to this configuration, the bottom surface portion protrudes so as to become large in height as the bottom surface portion extends toward the middle portion of the bottom surface portion. Therefore, for example, when force is applied to the bottom surface portion from an upper side, a compressive load which hardly causes deformation as compared to a tensile load is applied to the bottom surface portion. As a result, the rigidity of the bottom part can be increased. In addition, the outer peripheral portion arranged so as to surround the bottom surface portion is formed in an annular shape. Therefore, the deformation of the bottom surface portion which spreads outward by the force applied from the upper side can be suppressed by the outer peripheral portion. As a result, the rigidity of the bottom part can be further increased. Moreover, since the rigidity of the bottom part can be increased by the above configuration, the bottom part does not have to have a multiple structure. As a result, the bottom part can be easily manufactured and can be reduced in weight.

DESCRIPTION OF THE PREFERRED EMBODIMENTS

Outline of Golf Bag

Figure 1:
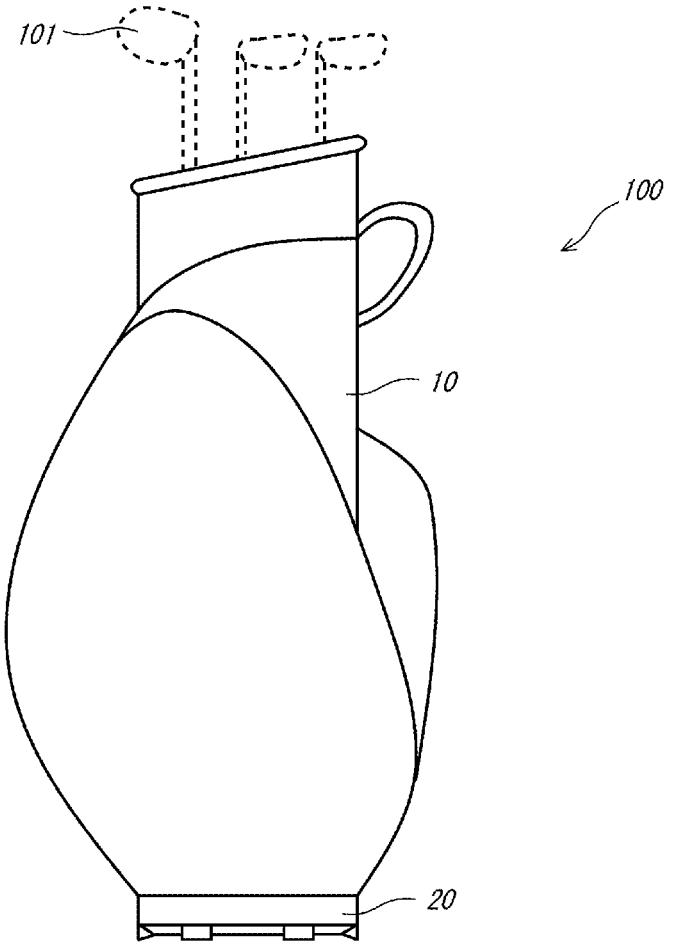
FIG. 1 is a schematic diagram of a golf bag.

Hereinafter, a golf bag 100 according to one embodiment of the present disclosure will be described. First, the outline of the golf bag 100 will be described. FIG. 1 is a schematic diagram of the golf bag 100. The golf bag 100 includes: a tubular bag main body 10 housing golf clubs 101; and a bottom part 20 attached to a lower end of the bag main body 10.

A material of the bag main body 10 is not especially limited. For example, the bag main body 10 may be formed by covering a resin body core with a fabric cover. Moreover, the bottom part 20 of the present embodiment is made of resin. The bottom part 20 is attached to the lower end of the bag main body 10 so as to be fixed to the lower end. For example, the bottom part 20 may be fixed to the bag main body 10 by adhesion using an adhesive and sewing. When rigidity of the bottom part 20 of the golf bag 100 is high, the bottom part 20 hardly deforms. As a result, falling-down of the golf bag 100 can be suppressed.

Details of Bottom Part

Figure 2:
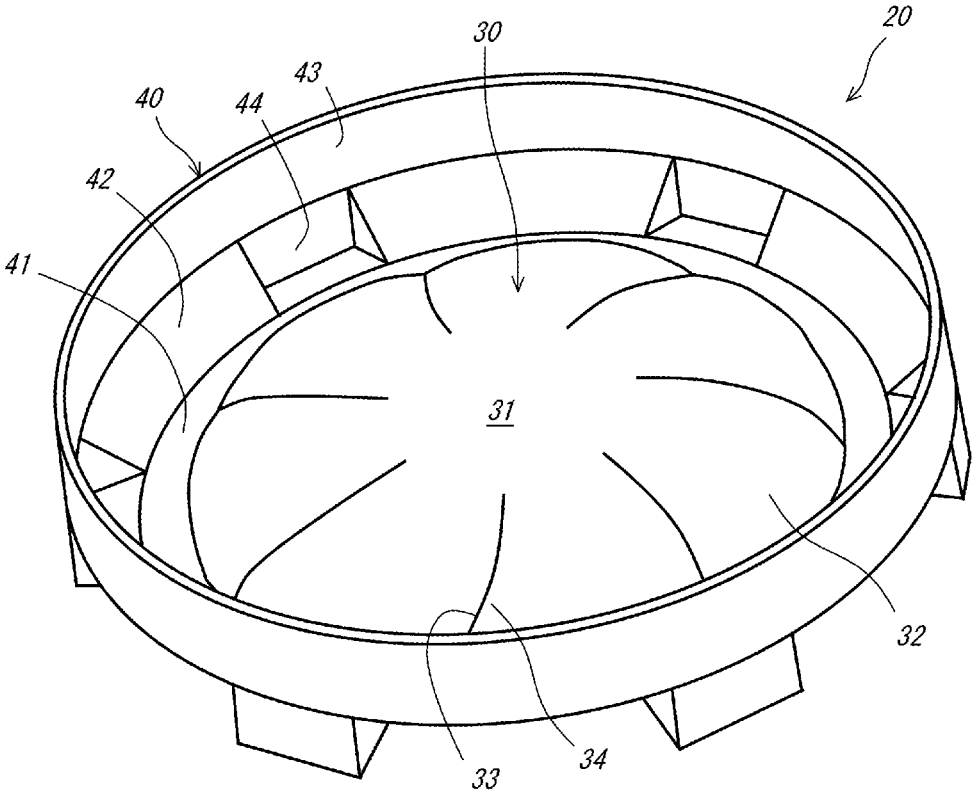
FIG. 2 is a perspective view showing a bottom part of the golf bag when viewed from an upper surface side of the bottom part.
Figure 3:
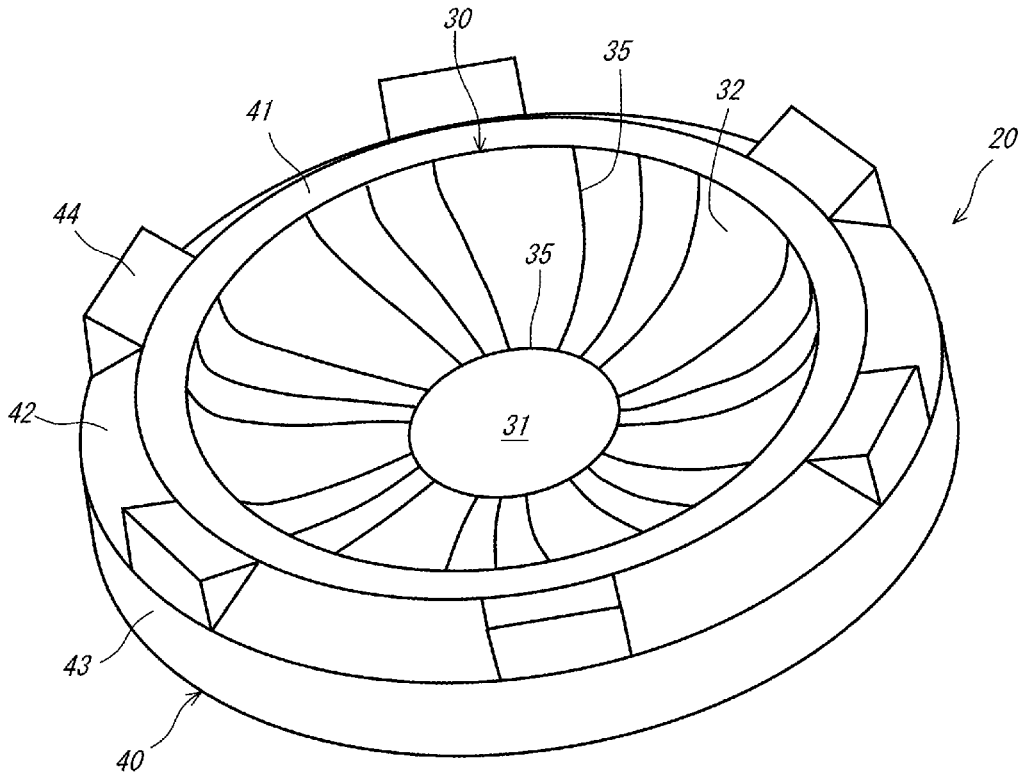
FIG. 3 is a perspective view showing the bottom part of the golf bag when viewed from a lower surface side of the bottom part.

Next, the details of the bottom part 20 will be described. FIG. 2 is a perspective view showing the bottom part 20 when viewed from an upper surface side of the bottom part 20. FIG. 3 is a perspective view showing the bottom part 20 when viewed from a lower surface side of the bottom part 20. As shown in FIGS. 2 and 3, the bottom part 20 includes a bottom surface portion 30 and an outer peripheral portion 40. Hereinafter, these components will be described in order.

Bottom Surface Portion

The bottom surface portion 30 is located at a middle of the bottom part 20. The bottom surface portion 30 of the present embodiment protrudes so as to become large in height as the bottom surface portion 30 extends from an outer peripheral edge of the bottom surface portion 30 to a middle portion 31 of the bottom surface portion 30. To be specific, the bottom surface portion 30 is formed in a dome shape as a whole. Therefore, for example, when force is applied to the bottom surface portion 30 from an upper side, a compressive load which hardly causes deformation as compared to a tensile load is applied to the bottom surface portion 30. Therefore, the rigidity of the entire bottom part 20 can be increased by making the bottom surface portion 30 protrude as in the present embodiment.

The bottom surface portion 30 will be described in more detail. The bottom surface portion 30 includes the middle portion 31 and a protruding portion 32.

The middle portion 31 includes a center point of the bottom surface portion 30 in plan view. In the present embodiment, the middle portion 31 is formed in a horizontal plane shape. However, the middle portion 31 may be formed in a partially spherical shape.

The protruding portion 32 is an annular portion arranged so as to surround an entire periphery of the middle portion 31. The protruding portion 32 is formed so as to become large in height as the protruding portion 32 extends from an outer peripheral edge of the protruding portion 32 to the middle portion 31. In the present embodiment, the protruding portion 32 is formed in a curved shape. Moreover, the protruding portion 32 includes valley portions 33 that project downward. Each of the valley portions 33 extends linearly from the middle portion 31 to the outer peripheral edge.

Instead of or in addition to the valley portions 33, the protruding portion 32 may include mountain portions that project upward. Inflection portions 34 each having a section that changes from a depression to a projection are formed around the respective valley portions 33 and the respective mountain portions. The inflection portions 34 and their vicinities can serve as beams or pillars in the bottom surface portion 30. Therefore, the rigidity of the bottom part 20 is increased by including the inflection portions 34 in the bottom surface portion 30 as in the present embodiment.

Moreover, each of the valley portions 33 is curved in plan view. Specifically, each of the valley portions 33 curves such that a position of the valley portion 33 in a circumferential direction changes as the valley portion 33 extends toward the outer peripheral edge of the bottom surface portion 30. With this, the inflection portions 34 are formed in a wide range of the bottom surface portion 30. As a result, the rigidity of the bottom part 20 can be further increased. The valley portions 33 appear on a lower surface of the bottom surface portion 30. For example, when the golf bag 100 is carried, the valley portions 33 may be seen. Therefore, the curves of the valley portions 33 are preferable from the viewpoint of design.

Moreover, as shown in FIG. 3, reinforced portions (ribs) 35 that are larger in thickness than adjacent portions are formed on the lower surface of the bottom surface portion 30. In the present embodiment, one reinforced portion 35 is formed in an annular shape along an outer peripheral edge of the middle portion 31, and the other reinforced portions 35 are formed linearly so as to extend from the middle portion 31 to the outer peripheral edge of the bottom surface portion 30. The three reinforced portions 35 extending from the middle portion 31 to the outer peripheral edge of the bottom surface portion 30 are formed at a portion between the adjacent valley portions 33. Moreover, the reinforced portions 35 extending from the middle portion 31 to the outer peripheral edge of the bottom surface portion 30 can suppress the deformation of the bottom surface portion 30 in an upper-lower direction. Therefore, the rigidity of the bottom part 20 can be further increased.

Furthermore, the reinforced portions 35 are formed so as to project downward from the lower surface of the bottom surface portion 30. Therefore, when the golf bag 100 is viewed from a lower side, the reinforced portions 35 can be visually confirmed. On this account, the formation of the reinforced portions 35 projecting downward from the lower surface of the bottom surface portion 30 as in the present embodiment is preferable from the viewpoint of design. However, the reinforced portions 35 may be formed so as to project upward from an upper surface of the bottom surface portion 30. The shapes of the reinforced portions 35 are not limited to the above shapes. For example, the reinforced portions 35 may be formed in a honeycomb shape.

Figure 4:
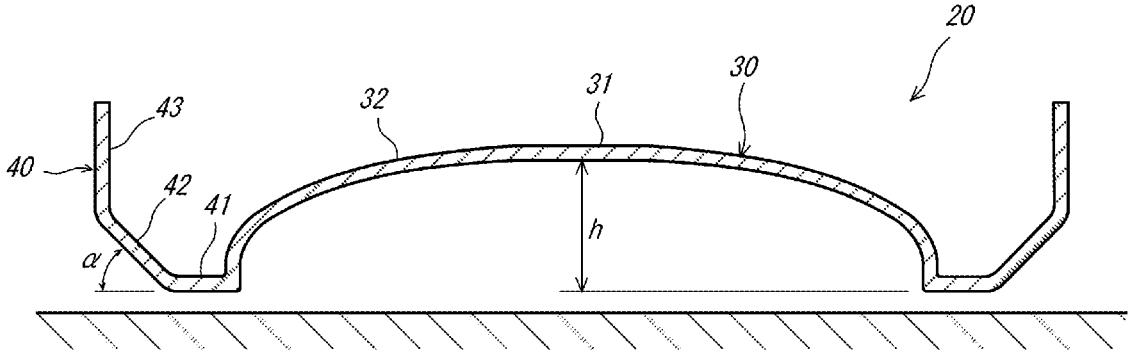
FIG. 4 is a longitudinal sectional view showing a portion of the bottom part at which portion there are no legs.

A protrusion height (height difference) h of the bottom surface portion 30 is not especially limited but is desirably 10 mm or more and 30 mm or less (see FIG. 4). The high rigidity of the bottom part 20 can be secured by setting the protrusion height h of the bottom surface portion 30 to 10 mm or more. Moreover, by setting the protrusion height h of the bottom surface portion 30 to 30 mm or less, a housing region of the golf bag 100 can be prevented from being reduced.

Outer Peripheral Portion

The outer peripheral portion 40 is arranged so as to surround the bottom surface portion 30. The outer peripheral portion 40 of the present embodiment is annular and formed integrally with the bottom surface portion 30. As described above, the bottom surface portion 30 of the present embodiment protrudes so as to become large in height as the bottom surface portion 30 extends toward the middle portion 31. Therefore, for example, when force is applied to the bottom surface portion 30 from the upper side, the bottom surface portion 30 deforms so as to spread outward. However, since the outer peripheral portion 40 formed integrally with the bottom surface portion 30 is formed in an annular shape and surrounds the entire periphery of the bottom surface portion 30, the deformation of the bottom surface portion 30 is suppressed. As a result, the rigidity of the bottom part 20 can be further increased.

The outer peripheral portion 40 will be described in more detail. As shown in FIG. 2, the outer peripheral portion 40 includes a horizontal portion 41, an inclined portion 42, and an upright wall portion 43.

The horizontal portion 41 is located outside the bottom surface portion 30 and is continuous with the bottom surface portion 30. The horizontal portion 41 is formed in an annular shape and surrounds the bottom surface portion 30. The horizontal portion 41 is formed perpendicular to a vertical direction (i.e., formed horizontally). Therefore, the horizontal portion 41 hardly deforms by force acting in the horizontal direction. On this account, the outer peripheral portion 40 including the horizontal portion 41 can efficiently suppress the deformation of the bottom surface portion 30 in the horizontal direction. The horizontal portion 41 may be eliminated from the outer peripheral portion 40. The horizontal portion 41 may be inclined so as to become small in height as the horizontal portion 41 extends outward.

The inclined portion 42 is located outside the horizontal portion 41 and is continuous with the horizontal portion 41. The inclined portion 42 is formed in an annular shape and surrounds the horizontal portion 41. The inclined portion 42 is inclined so as to become large in height as the inclined portion 42 extends outward (as the inclined portion 42 extends away from the bottom surface portion 30). A tilt angle c of the inclined portion 42 is not especially limited but is desirably 30° or more and 60° or less (see FIG. 4).

Figure 5:
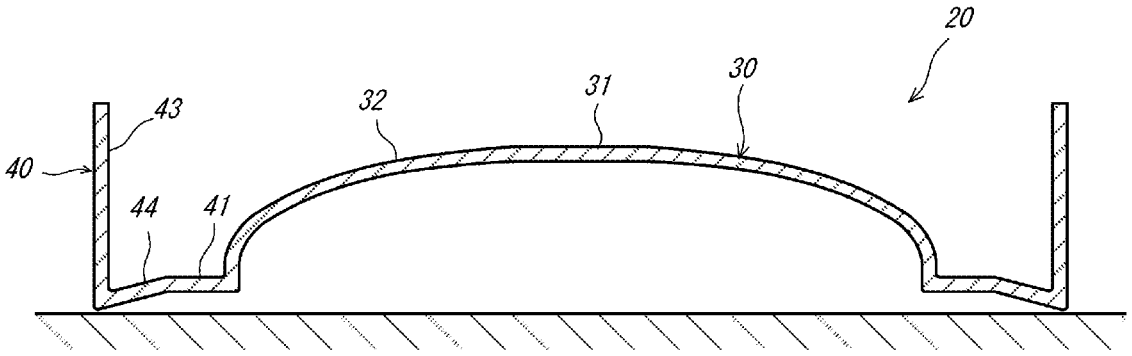
FIG. 5 is a longitudinal sectional view showing a portion of the bottom part at which portion there are the legs.

Moreover, legs 44 are formed at the inclined portion 42 at regular intervals in the circumferential direction. FIG. 4 is a longitudinal sectional view showing a portion of the bottom part 20 at which portion there are no legs 44. FIG. 5 is a longitudinal sectional view showing a portion of the bottom part 20 at which portion there are the legs 44. As is clear from the comparison between FIGS. 4 and 5, the legs 44 are depressed outward, and tip ends of the legs 44 are located lower than the horizontal portion 41 and are in contact with a ground surface (i.e., is grounded). However, the tip ends of the legs 44 may be the same in height as the horizontal portion 41. By forming the legs 44 at the inclined portion 42 as in the present embodiment, the rigidity of portions corresponding to the legs 44 in the vertical direction and the horizontal direction is increased. In addition, since the legs 44 are formed by outward depressed portions of the inclined portion 42, it is unnecessary to separately manufacture and attach the legs 44.

The upright wall portion 43 extends upward from the inclined portion 42 and is continuous with the inclined portion 42. The upright wall portion 43 is formed in an annular shape and extends in the upper-lower direction. The upright wall portion 43 is fixed to a lower end portion of the bag main body 10. Since the outer peripheral portion 40 includes the upright wall portion 43 extending in the upper-lower direction, the outer peripheral portion 40 hardly deforms in the upper-lower direction, and for example, the rigidity of the outer peripheral portion 40 with respect to twisting around a horizontal axis can be increased.

As shown in FIGS. 4 and 5, the entire bottom part 20 of the present embodiment is substantially constant in thickness and is thin except for the reinforced portions 35. The bottom part 20 of the present embodiment is formed to have a thickness of 0.8 mm or more and 2.0 mm or less. Moreover, since the bottom part 20 of the present embodiment can secure adequate rigidity, the bottom part 20 does not have to have a multiple structure. Therefore, the bottom part 20 of the present embodiment can be reduced in weight. The bottom part 20 of the present embodiment is formed to have a weight of 80 g or more and 150 g or less. Furthermore, since the bottom part 20 of the present embodiment can be manufactured by, for example, simple injection molding, the bottom part 20 is easily manufactured.

Modified Example

Figure 6:
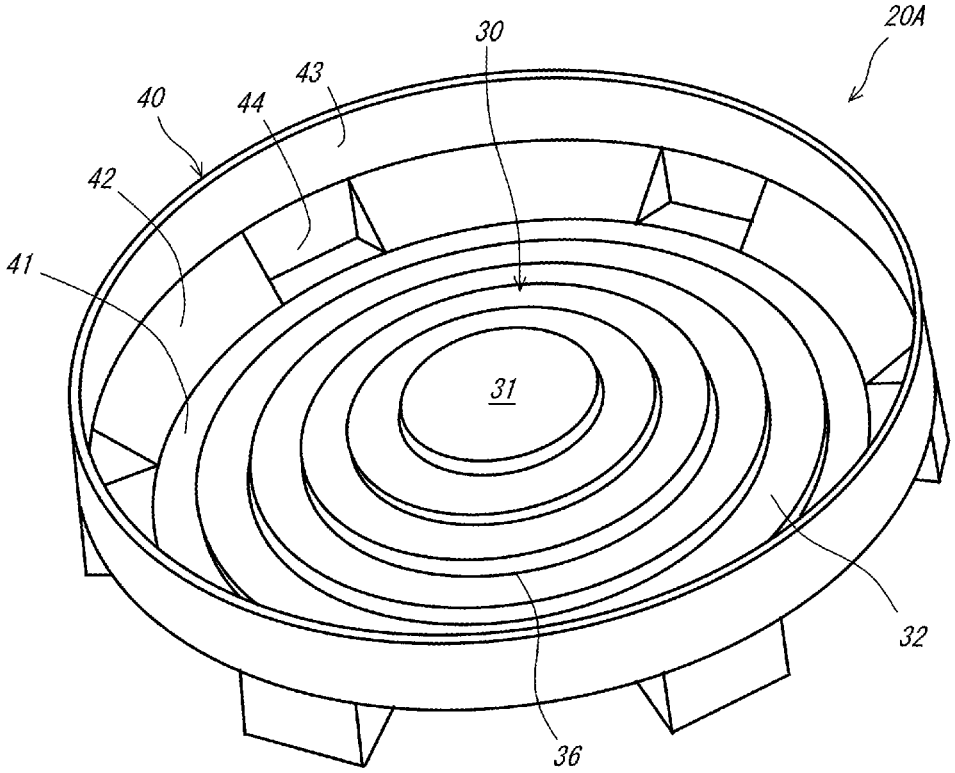
FIG. 6 is a perspective view showing a bottom part of Modified Example when viewed from an upper surface side of the bottom part.

The above-described golf bag 100 includes the bottom part 20 shown in FIG. 2. However, the golf bag 100 may include a bottom part 20A shown in FIG. 6. FIG. 6 is a perspective view showing the bottom part 20A of Modified Example when viewed from an upper surface side of the bottom part 20A. The bottom part 20A of Modified Example is the same as the bottom part 20 except for the shape of the bottom surface portion 30.

In the bottom part 20A of Modified Example, the bottom surface portion 30 protrudes so as to become large in height as the bottom surface portion 30 extends toward the middle portion 31. However, the bottom surface portion 30 is formed in a stair shape. To be specific, the bottom surface portion 30 is formed such that annular portions extending in the upper-lower direction and annular portions extending in the horizontal direction are alternately and continuously arranged from the middle portion 31 toward an outer side. Then, in sectional view, boundaries each between the adjacent annular portions is bent. To be specific, the bottom surface portion 30 shown in FIG. 6 includes bent portions 36 each having a bent section.

As with the inflection portions 34 (see FIG. 2), the bent portions 36 and their vicinities can serve as beams or pillars. Therefore, the rigidity of the bottom part 20A shown in FIG. 6 can also be increased. Moreover, since the bottom part 20A can secure adequate rigidity, the bottom part 20A does not have to have a multiple structure. Thus, the bottom part 20A can be easily manufactured and can be reduced in weight.

Each of the bottom parts 20 and 20A described above is formed in a circular shape in plan view. However, the shapes of the bottom parts 20 and 20A are not limited to this. For example, each of the bottom parts 20 and 20A may have an oval shape or a rectangular shape in plan view.

Moreover, the bottom part 20A shown in FIG. 6 may be partially applied to the bottom part 20 shown in FIG. 2. To be specific, the bottom part 20 may include both the inflection portions 34 and the bent portions 36. Furthermore, the bottom part 20 may be formed so as not to include: a portion having a depressed section as a whole; the inflection portions 34; and the bent portions 36.

Conclusion

A first aspect of the present disclosure is a golf bag including: a tubular bag main body housing a golf club; and a bottom part attached to a lower end of the bag main body and including a bottom surface portion and an annular outer peripheral portion, the bottom surface portion protruding so as to become large in height as the bottom surface portion extends toward a middle portion of the bottom surface portion, the outer peripheral portion being arranged so as to surround the bottom surface portion and integrated with the bottom surface portion.

According to this configuration, the bottom surface portion protrudes so as to become large in height as the bottom surface portion extends toward the middle portion of the bottom surface portion. Therefore, for example, when force is applied to the bottom surface portion from an upper side, a compressive load which hardly causes deformation as compared to a tensile load is applied to the bottom surface portion. As a result, the rigidity of the bottom part can be increased. In addition, the outer peripheral portion arranged so as to surround the bottom surface portion is formed in an annular shape. Therefore, the deformation of the bottom surface portion which spreads outward by the force applied from the upper side can be suppressed by the outer peripheral portion. As a result, the rigidity of the bottom part can be further increased. Moreover, since the rigidity of the bottom part can be increased by the above configuration, the bottom part does not have to have a multiple structure. As a result, the bottom part can be easily manufactured and can be reduced in weight.

A second aspect of the present disclosure is the golf bag according to the first aspect of the present disclosure, wherein a protrusion height of the bottom surface portion is 10 mm or more and 30 mm or less.

According to this configuration, since the protrusion height of the bottom surface portion is 10 mm or more, the high rigidity of the bottom part can be secured. Moreover, since the protrusion height of the bottom surface portion is 30 mm or less, a housing region of the golf bag can be prevented from being reduced.

A third aspect of the present disclosure is the golf bag according to the first aspect of the present disclosure, wherein the outer peripheral portion includes an annular horizontal portion perpendicular to a vertical direction.

Since the horizontal portion included in the outer peripheral portion is perpendicular to the vertical direction, the horizontal portion hardly deforms by force acting in a horizontal direction. Therefore, according to the above configuration, the deformation of the bottom surface portion that spreads outward can be further suppressed by the outer peripheral portion.

A fourth aspect of the present disclosure is the golf bag according to the first aspect of the present disclosure, wherein the bottom surface portion includes a reinforced portion that is larger in thickness than the other portion of the bottom surface portion and extends linearly from the middle portion of the bottom surface portion toward an outer peripheral edge of the bottom surface portion.

According to this configuration, the reinforced portion extends linearly from the middle portion of the bottom surface portion toward the outer peripheral edge of the bottom surface portion. Therefore, the reinforced portion can suppress the deformation of the bottom surface portion in an upper-lower direction. As a result, the rigidity of the bottom part can be further increased.

A fifth aspect of the present disclosure is the golf bag according to the fourth aspect of the present disclosure, wherein the reinforced portion projects downward from a lower surface of the bottom surface portion.

According to this configuration, when the golf bag is viewed from a lower side, the reinforced portion can be visually confirmed. Therefore, according to the above configuration, the rigidity of the bottom part can be increased, and in addition, the design is also preferable.

A sixth aspect of the present disclosure is a golf bag including: a tubular bag main body housing a golf club; and a bottom part attached to a lower end of the bag main body and including a bottom surface portion protruding so as to become large in height as the bottom surface portion extends toward a middle portion of the bottom surface portion, the bottom surface portion including one or both of an inflection portion and a bent portion, the inflection portion including a section that changes from a depression to a projection, the bent portion including a bent section.

According to this configuration, the bottom surface portion protrudes so as to become large in height as the bottom surface portion extends toward the middle portion of the bottom surface portion. Therefore, for example, when force is applied to the bottom surface portion from an upper side, a compressive load which hardly causes deformation as compared to a tensile load is applied to the bottom surface portion. As a result, the rigidity of the bottom part can be increased. In addition, the bottom surface portion includes one or both of: the inflection portion having a section that changes from a depression to a projection; and the bent portion having a bent section. The inflection portion and its vicinity can serve as a beam or a pillar, and the bent portion and its vicinity can serve as a beam or a pillar. As a result, the rigidity of the bottom part can be further improved. Moreover, since the rigidity of the bottom part can be improved by the above configuration, the bottom part does not have to have a multiple structure. As a result, the bottom part can be easily manufactured and can be reduced in weight.

A seventh aspect of the present disclosure is the golf bag according to the sixth aspect of the present disclosure, wherein a protrusion height of the bottom surface portion is 10 mm or more and 30 mm or less.

According to this configuration, since the protrusion height of the bottom surface portion is 10 mm or more, the high rigidity of the bottom part can be secured. Moreover, since the protrusion height of the bottom surface portion is 30 mm or less, the housing region of the golf bag can be prevented from being reduced.

An eighth aspect of the present disclosure is the golf bag according to the sixth aspect of the present disclosure, wherein a bottom surface portion includes a valley portion that extends from the middle portion of the bottom surface portion to an outer peripheral edge of the bottom surface portion and projects downward.

According to this configuration, since the valley portion extending from the middle portion of the bottom surface portion to the outer peripheral edge of the bottom surface portion is formed, the inflection portion extending from the middle portion to the outer peripheral edge is formed along the valley portion at the bottom surface portion. As a result, the deformation of the bottom surface portion in the upper-lower direction can be suppressed, and the rigidity of the bottom part can be further increased.

A ninth aspect of the present disclosure is the golf bag according to the eighth aspect of the present disclosure, wherein the valley portion is curved in plan view.

According to this configuration, the valley portion is curved in plan view. Therefore, the inflection portion is formed in a wide range of the bottom surface portion in a circumferential direction. As a result, the rigidity of the bottom part can be further increased.

A tenth aspect of the present disclosure is the golf bag according to the sixth aspect of the present disclosure, wherein the bottom surface portion is in a stair shape.

According to this configuration, the bottom surface portion is formed in a stair shape. Therefore, the bottom surface portion includes bent portions that are different in position in the upper-lower direction from each other. As a result, the bent portions are formed in a wide range of the bottom surface portion, and the rigidity of the bottom part can be further increased.

An eleventh aspect of the present disclosure is a golf bag including: a tubular bag main body housing a golf club; and a bottom part attached to a lower end of the bag main body and including a bottom surface portion and an annular outer peripheral portion, the outer peripheral portion being arranged so as to surround the bottom surface portion and integrated with the bottom surface portion, the outer peripheral portion including an annular inclined portion inclined so as to become large in height as the inclined portion extends away from the bottom surface portion, the inclined portion including legs depressed outward.

According to this configuration, the inclined portion of the outer peripheral portion includes the legs depressed outward. By forming outward depressed portions at the inclined portion, the rigidity of the bottom part in the vertical direction and the horizontal direction at the outward depressed portions can be increased. Moreover, since the rigidity of the bottom part can be increased, the bottom part does not have to have a multiple structure. As a result, the bottom part can be easily manufactured and can be reduced in weight. In addition, since the legs are formed by outward depressed portions, it is unnecessary to separately manufacture and attach the legs. Thus, the bottom part can be easily manufactured.

A twelfth aspect of the present disclosure is the golf bag according to the eleventh aspect of the present disclosure, wherein the legs are located at regular intervals in a circumferential direction.

According to this configuration, since the legs are formed at regular intervals in the circumferential direction, the rigidity of the bottom part can be increased over the entire periphery.

A thirteenth aspect of the present disclosure is the golf bag according to the eleventh aspect of the present disclosure, wherein the bottom surface portion protrudes so as to become large in height as the bottom surface portion extends toward a middle of the bottom surface portion.

According to this configuration, the bottom surface portion protrudes so as to become large in height as the bottom surface portion extends toward the middle portion of the bottom surface portion. Therefore, for example, when force is applied to the bottom surface portion from an upper side, a compressive load which hardly causes deformation as compared to a tensile load is applied to the bottom surface portion. On this account, the rigidity of the bottom part can be increased.

A fourteenth aspect of the present disclosure is the golf bag according to the thirteenth aspect of the present disclosure, wherein a protrusion height of the bottom surface portion is 10 mm or more and 30 mm or less.

According to this configuration, since the protrusion height of the bottom surface portion is 10 mm or more, the high rigidity of the bottom part can be secured. Moreover, since the protrusion height of the bottom surface portion is 30 mm or less, the housing region of the golf bag can be prevented from being reduced.

A fifteenth aspect of the present disclosure is the golf bag according to the eleventh aspect of the present disclosure, wherein the outer peripheral portion includes an annular upright wall portion extending in an upper-lower direction.

According to this configuration, the outer peripheral portion includes the annular upright wall portion extending in the upper-lower direction. Therefore, the outer peripheral portion hardly deforms in the upper-lower direction, and for example, the rigidity of the outer peripheral portion with respect to twisting around a horizontal axis can be increased.

What is claimed is:

1. A golf bag comprising:

a tubular bag main body housing a golf club; and a bottom part attached to a lower end of the bag main body and including a bottom surface portion and an annular outer peripheral portion, the bottom surface portion protruding so as to become large in height as the bottom surface portion extends toward a middle portion of the bottom surface portion, the outer peripheral portion including an upright wall portion formed in an annular shape and extending in a direction parallel to the tubular bag main body, the upright wall portion being arranged so as to surround the bottom surface portion and the outer peripheral portion being integrated with the bottom surface portion, wherein the outer peripheral portion and the bottom surface portion are formed as a single molded structure, wherein the outer peripheral portion further includes an annular horizontal portion perpendicular to a vertical direction, and an inclined portion located between the upright wall portion and the annular horizontal portion, wherein leg portions are located at the inclined portion at regular intervals in a circumferential direction of the annular horizontal portion, and wherein the leg portions are depressed outward from the inclined portion, and lower ends of the leg portions are linear and located lower than the horizontal portion.

2. The golf bag according to claim 1, wherein a protrusion height of the bottom surface portion is 10 mm or more and 30 mm or less.

3. The golf bag according to claim 1, wherein the annular horizontal portion is integrally connected to an outermost peripheral edge of the bottom surface portion in the single molded structure.

4. The golf bag according to claim 1, wherein the bottom surface portion includes a reinforced portion that is larger in thickness than a portion adjacent to the reinforced portion of the bottom surface portion and extends linearly from the middle portion of the bottom surface portion toward an outer peripheral edge of the bottom surface portion.

5. The golf bag according to claim 4, wherein the reinforced portion projects downward from a lower surface of the bottom surface portion.

* * * * *